US011187244B2

(12) United States Patent
Liu et al.

(10) Patent No.: US 11,187,244 B2
(45) Date of Patent: Nov. 30, 2021

(54) REFLUX DEVICE BLADE COMPRESSOR

(71) Applicants: Gree Electric Appliances (Wuhan) Co., Ltd., Wuhan (CN); Gree Electric Appliances, Inc. of Zhuhai, Zhuhai (CN)

(72) Inventors: Zengyue Liu, Zhuhai (CN); Ruixing Zhong, Zhuhai (CN); Nan Jiang, Zhuhai (CN); Caiyun Jiang, Zhuhai (CN); Yuhui Chen, Zhuhai (CN); Yi Zhou, Zhuhai (CN); Liandong Lei, Zhuhai (CN); Xinwang Ouyang, Zhuhai (CN)

(73) Assignees: Gree Electric Appliances (Wuhan) Co., Ltd., Wuhan (CN); Gree Electric Appliances, Inc. of Zhuhai, Zhuhai (CN)

( * ) Notice: Subject to any disclaimer, the term of this patent is extended or adjusted under 35 U.S.C. 154(b) by 153 days.

(21) Appl. No.: 16/611,608

(22) PCT Filed: Dec. 22, 2017

(86) PCT No.: PCT/CN2017/118108
§ 371 (c)(1),
(2) Date: Nov. 7, 2019

(87) PCT Pub. No.: WO2018/205631
PCT Pub. Date: Nov. 15, 2018

(65) Prior Publication Data

US 2020/0158134 A1 May 21, 2020

(30) Foreign Application Priority Data

May 11, 2017 (CN) ..... 201710331361.8

(51) Int. Cl.
*F04D 29/44* (2006.01)
*F04D 17/12* (2006.01)
(Continued)

(52) U.S. Cl.
CPC ..... *F04D 29/444* (2013.01); *F04D 17/12* (2013.01); *F04D 29/4206* (2013.01);
(Continued)

(58) Field of Classification Search
CPC .... F04D 17/12; F04D 29/4206; F04D 29/444; F04D 29/684; F04D 29/667; F05D 2240/12; F05D 2240/124
See application file for complete search history.

(56) References Cited

U.S. PATENT DOCUMENTS 3,749,520 A 7/1973 Bandukwalla
4,695,224 A * 9/1987 Lown ..... F04D 29/5846 415/116
(Continued)

FOREIGN PATENT DOCUMENTS

CN 101608631 B 2/2012
CN 104595247 A 5/2015
(Continued)

*Primary Examiner* — Charles G Freay
(74) *Attorney, Agent, or Firm* — The Webb Law Firm

(57) ABSTRACT

Embodiments of the present disclosure describe a reflux device blade and a compressor. The reflux device blade includes a blade main body, a hollow cavity is formed in the blade main body, and an air supplement hole is formed in the blade main body. When the hollow reflux device blade is adopted, the supplemental air entering the hollow cavity of the reflux device blade through an air supplement channel forms jet flow on a suction surface of the reflux device blade to blow off a low-speed low-energy area formed on the suction surface, so as to reduce the airflow mixing loss, prevent the intake distortion of a second-stage impeller, and improve the operation range of the compressor.

6 Claims, 2 Drawing Sheets

(51) Int. Cl.
*F04D 29/42* (2006.01)
*F04D 29/66* (2006.01)
*F04D 29/68* (2006.01)

(52) U.S. Cl.
CPC ..... *F04D 29/667* (2013.01); *F04D 29/684* (2013.01); *F05D 2240/12* (2013.01); *F05D 2240/124* (2013.01)

(56) References Cited

U.S. PATENT DOCUMENTS

| | | | | |
|---|---|---|---|---|
| 7,261,513 | B2 | 8/2007 | Umeyama et al. | |
| 7,641,439 | B2 * | 1/2010 | Chen | F04D 17/122 415/116 |
| 9,382,911 | B2 * | 7/2016 | Sun | F25B 1/053 |
| 10,731,664 | B2 | 8/2020 | Iurisci et al. | |
| 2006/0115358 | A1 | 6/2006 | Umeyama et al. | |
| 2016/0221273 | A1 * | 8/2016 | Foresto | B29C 33/046 |

FOREIGN PATENT DOCUMENTS

| | | | | |
|---|---|---|---|---|
| CN | 204532973 | U | | 8/2015 |
| CN | 105370626 | A | | 3/2016 |
| CN | 106194783 | A | | 12/2016 |
| CN | 107013497 | A | | 8/2017 |
| CN | 107023516 | A | | 8/2017 |
| EP | 2990662 | A1 | | 3/2016 |
| GB | 775784 | | * | 5/1957 |
| JP | H8284892 | A | | 10/1996 |
| JP | H979192 | A | | 3/1997 |
| JP | 2004-300929 | A | * | 10/2004 |

* cited by examiner

REFLUX DEVICE BLADE COMPRESSOR

CROSS-REFERENCE TO RELATED APPLICATIONS

This application is the United States national phase of International Application No. PCT/CN2017/118108 filed Dec. 22, 2017, and claims priority to Chinese Patent Application No. 201710331361.8 filed May 11, 2017, the disclosures of which are hereby incorporated by reference in their entirety.

BACKGROUND OF THE INVENTION

Field of the Invention

The present disclosure relates to the field of compressors, and in particular to a reflux device blade, and a compressor.

Description of Related Art

In a centrifugal compressor, after air is compressed, the temperature rises sharply, therefore the specific volume of the air is large at a high temperature, and the energy consumption of the compressor is increased sharply under the condition of ensuring the same cooling capacity. In order to reduce the power consumption of the compressor and improve the refrigeration capacity, a multi-stage compression refrigeration cycle is commonly used.

A two-stage compression intermediate incomplete cooling refrigeration cycle with a flash steam separator (known as an economizer) is widely used at present. The two-stage compression refrigeration cycle is to mix flash steam separated from the economizer with an exhaust gas from low-stage compression, which reduces the air inlet temperature of the two-stage compression, reduces the specific volume of the refrigerant gas, and reduces the energy consumption of the compressor.

In the related art, the two-stage compression refrigeration cycle is adopted, a refrigerant can only reach the inlet of a second-stage impeller by passing through a diffuser, a curve and a reflux device after being compressed by a first-stage impeller, and the reflux device provided with blades to eliminate the circumferential speed of the incoming flow, such that the flow direction at the inlet of the second-stage impeller is axial.

However, when the compressor is running at a non-design operating condition, the angle of attack of the incoming flow of the reflux device blade is relatively large, the flow in the reflux device is likely to be separated, resulting in intake distortion of the second-stage impeller, which affects the performance of the compressor. In addition, in an air supplement scheme in the related art, the main flow and the air supplement flow are different on the values and directions of the airflow speeds, so that relatively large airflow mixing loss is generated during the air supplement, and the aerodynamic efficiency of the compressor is reduced.

SUMMARY OF THE INVENTION

An embodiment of the present disclosure provides a reflux device blade and a compressor, in order to reduce the airflow mixing loss caused by air supplement and/or prevent the intake distortion of a second-stage impeller.

Non-limiting embodiments or aspects of the present disclosure provide a reflux device blade, including: a blade main body, a hollow cavity formed in the blade main body, and an air supplement hole formed on the blade main body.

In some non-limiting embodiments or aspects, the air supplement hole is formed on a suction surface of the blade main body.

In some non-limiting embodiments or aspects, the blade main body is made by casting or machining.

Optionally, the compressor further includes a shell, and an air supplement channel communicating with the hollow cavity of the reflux device blade is formed in the shell.

Optionally, the compressor further includes a first-stage impeller and a second-stage impeller, and the output airflow of the first-stage impeller enters the second-stage impeller through a reflux device flow channel provided with the reflux blade.

In some non-limiting embodiments or aspects, the output of the first-stage impeller enters the reflux device flow channel through a first-stage diffuser flow channel.

In some non-limiting embodiments or aspects, the transition between the first-stage diffuser flow channel and the reflux device flow channel is formed into a curve.

In some non-limiting embodiments or aspects, a second-stage diffuser is installed on an output end of the second-stage impeller.

When the hollow reflux device blade in the present disclosure is adopted, the supplemental air entering the hollow cavity of the reflux device blade through the air supplement channel forms a jet flow on the suction surface of the reflux device blade to blow off a low-speed low-energy area formed on the suction surface, so as to reduce the airflow mixing loss, prevent the intake distortion of the second-stage impeller, and improve the operation range of the compressor.

REFERENCE SIGNS

1—blade main body;
2—hollow cavity;
3—air supplement hole;
4—reflux device blade;
5—air supplement channel;
6—first-stage impeller;
7—second stage impeller;
8—reflux device flow channel;
9—first-stage diffuser flow channel;
10—second-stage diffuser flow channel
11—first-stage diffuser blade;
12—second-stage diffuser blade;
13—volute.

DESCRIPTION OF THE INVENTION

The present disclosure is further described in detail below in combination with the drawings and specific embodiments, but the present disclosure is not limited thereto.

The purpose of the present disclosure is to provide a centrifugal compressor to reduce the airflow mixing loss caused by air supplement, prevent the intake distortion of a second-stage impeller and improve the operation range of the compressor.

The embodiment of the present disclosure provides a reflux device blade, including: a blade main body 1, a hollow cavity 2 is formed in the blade main body 1, and an air supplement hole 3 is formed in the blade main body 1.

Figure 1:
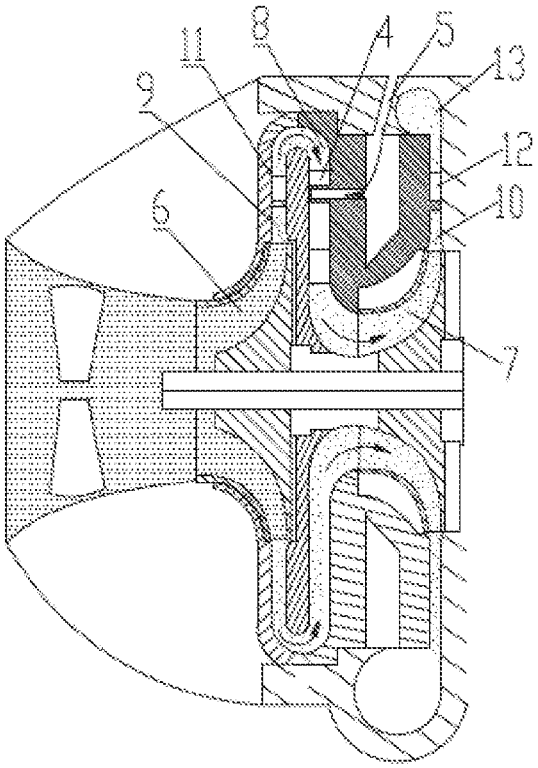
FIG. 1 is a schematic diagram of an air supplement reflux racemization structure of a centrifugal compressor in an embodiment of the present disclosure.
Figure 2:
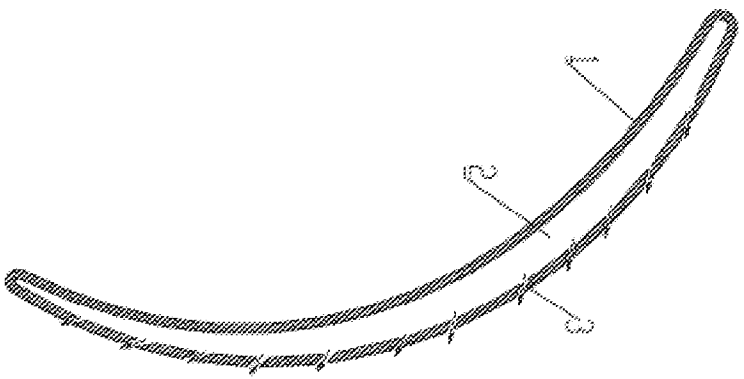
FIG. 2 is a sectional schematic diagram of a reflux device blade in an embodiment of the present disclosure.
Figure 3:
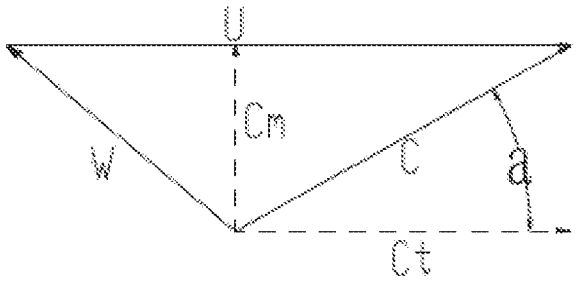
FIG. 3 is a triangular schematic diagram of an impeller outlet speed in an embodiment of the present disclosure.

Referring to FIGS. 1 to 3, when the compressor is running at a design operating condition, after an air refrigerant passes through a first-stage impeller 6, since the refrigerant performs circular motion with the first-stage impeller 6, an absolute speed C of the airflow is composed of Cm and Ct. The refrigerant airflow enters a first-stage diffuser flow channel 9 at the absolute speed, then turns via the curve, impacts the reflux device blade 4 after a relatively small angle of attack to achieve racemization and enters a second-stage impeller 7. In FIG. 3, W represents a relative speed, U represents a rotating speed, C represents the absolute speed, and W+U=C.

When the reflux device blade in the present disclosure is not used, if the compressor runs deviating from the design operating condition, an absolute airflow angle a of the impeller outlet refrigerant is decreased, and the airflow impacts the reflux device blade 4 at a relatively large angle of attack after passing through a first-stage diffuser and the curve, such that the airflow is separated on a suction surface of the reflux device blade 4, and a relatively large low-speed low-energy are occurs, resulting in intake distortion of the second-stage impeller 7, which seriously affects the operation range of the compressor.

When the hollow reflux device blade (such as, the blade main body 1 is made by casting or machining) in the present disclosure is adopted, since the reflux device blade is provided with a miniature air supplement hole 3 on the back of the blade, the supplemental air entering the hollow cavity 2 through the air supplement channel 5 forms jet flow (an arrow in FIG. 2) on the suction surface of the reflux device blade 4 to blow off the low-speed low-energy area formed on the suction surface, so as to reduce the airflow mixing loss (airflow mixing loss), prevent the intake distortion of the second-stage impeller, and improve the operation range of the compressor.

Optionally, the air supplement hole 3 is formed on the suction surface of the blade main body 1. Further, by designing the position, angle and aperture size of the air supplement hole 3, that is, combining the position, angle and jet flow speed of the jet flow, the separation of the suction surface of the reflux device blade 4 at the non-design operating condition would be effectively suppressed.

The present disclosure further provides a compressor, and more particularly to a compressor air supplement reflux racemization structure, including the reflux device blade 4 described above.

In the embodiments, due to the jet flow air supplement on the back of the reflux device blade, the temperature and the specific volume of the refrigerant at the outlet of the first-stage impeller would be effectively reduced, and the aerodynamic efficiency of the second-stage impeller is improved. By forming the jet flow on the suction surface of the reflux device blade by means of air supplement, the low-speed low-energy area formed on the suction surface is blown off, the airflow separation loss is reduced, then the aerodynamic efficiency of the centrifugal compressor is improved, the intake distortion of the second-stage impeller would also be prevented, and the operation range of the compressor is improved.

Referring to FIG. 1, optionally, the compressor further includes a shell, and an air supplement channel 5 communicating with the hollow cavity 2 of the reflux device blade 4 is formed in the shell. The supplemental air would be introduced into the hollow cavity 2 through the air supplement channel 5.

Optionally, the compressor further includes a first-stage impeller 6 and a second-stage impeller 7, and the output airflow of the first-stage impeller 6 enters the second-stage impeller 7 through a reflux device flow channel 8 provided with the reflux blade 4. The output airflow of the first-stage impeller 6 enters the reflux device flow channel 8 through a first-stage diffuser flow channel 9. The transition between the first-stage diffuser flow channel 9 and the reflux device flow channel 8 is formed into a curve. A second-stage diffuser is further installed on an output end of the second-stage impeller 7.

During operation, when the refrigerant airflow passes through the first-stage impeller 6 and the first-stage diffuser flow channel 9 (in which a first-stage diffuser blade 11 is provided) and the curve in sequence to enter the reflux device flow channel 8, the supplemental air forms jet flow on the suction surface of the reflux device blade 4 to blow off the low-speed low-energy area formed on the suction surface, so as to reduce the airflow separation loss (airflow mixing loss) and to prevent the intake distortion of the second-stage impeller. Then, the refrigerant airflow flows by the second-stage impeller 7 and a second-stage diffuser flow channel 10 of the second-stage diffuser, and finally flows out from a volute 13, wherein a second-stage diffuser blade 12 is installed in the second-stage diffuser flow channel.

Of course, the above description refers to embodiments of the present disclosure. It should be noted that those of ordinary skill in the art can make several improvements and modifications without departing from the basic principles of the present disclosure, and these improvements and modifications are also regarded as the protection scope of the present disclosure.

The invention claimed is:

1. A compressor, comprising:

a reflux device blade, comprising a blade main body, a hollow cavity is formed in the blade main body, and an air supplement hole is formed on the blade main body;

a first-stage impeller and a second-stage impeller, the compressor configured to allow an output airflow of the first-stage impeller to flow through the second-stage impeller through a reflux device flow channel in which the reflux device blade is located;

a curved portion formed between a first-stage diffuser and the reflux device flow channel, the reflux device blade being located downstream of the curved portion; and the compressor configured to allow the output airflow of the first-stage impeller to flow through the curved portion, the reflux device flow channel with the reflux device blade and then the second-stage impeller.

2. The compressor according to claim 1, wherein the air supplement hole is formed on a suction surface of the blade main body.

3. The compressor according to claim 1, wherein the blade main body is made by casting or machining.

4. The compressor according to claim 1, further comprising a shell, and an air supplement channel communicating with the hollow cavity of the reflux device blade is formed in the shell.

5. The compressor according to claim 1, wherein the compressor is configured to allow the output airflow of the first-stage impeller enter the reflux device flow channel through a first-stage diffuser flow channel.

6. The compressor according to claim 4, wherein a second-stage diffuser is installed on an output end of the second-stage impeller.

* * * * *